US005493805A

United States Patent [19]

Penuela et al.

[11] Patent Number: 5,493,805

[45] Date of Patent: Feb. 27, 1996

[54] MEMORY CHIP HOLDER AND METHOD OF USING SAME

[75] Inventors: Oswaldo Penuela, Valencia; Fredrick R. Berghaus, Walnut, both of Calif.

[73] Assignee: Precision Dynamics Corporation, San Fernando, Calif.

[21] Appl. No.: 8,476

[22] Filed: Jan. 25, 1993

[51] Int. Cl.[6] ..... A44C 5/00

[52] U.S. Cl. ..... 40/633; 40/447

[58] Field of Search ..... 40/633, 304, 447, 40/449

[56] References Cited

U.S. PATENT DOCUMENTS

| | | | |
|---|---|---|---|
| 3,965,589 | 6/1976 | McDermott | 40/633 |
| 4,512,096 | 4/1985 | Heidecker | 40/304 |
| 4,835,372 | 5/1989 | Gombrich et al. | 235/375 |
| 5,012,229 | 4/1991 | Lennon et al. | 40/447 |
| 5,193,855 | 3/1993 | Shamos | 283/117 |

FOREIGN PATENT DOCUMENTS

| | | | |
|---|---|---|---|
| 4079995 | 1/1963 | France | 40/633 |
| 1292266 | 12/1963 | France . | |
| 2226809 | 12/1973 | Germany | 40/633 |

*Primary Examiner*—Thomas E. Denion
*Attorney, Agent, or Firm*—Thomas P. Mahoney

[57] ABSTRACT

A housing or holder for a memory chip button is useful as part of an identification bracelet assembly. The housing or holder preferably includes a body portion and a closure portion, such as an integral snap-type closure or sliding cover to overly the body portion and the button. The housing can be permanently or demountably fastened to a strap or bracelet, such as through use of a stud and socket structure or by openings in the housing which receive the strap. Alternatively, the strap can be integral with the housing. The strap can also function to help retain the button in the housing. A preferred method of use includes storing information in a chip button, inserting the chip button in a selected holder, attaching the holder/chip assembly to a person or thing to be associated with the stored information, and transmitting or otherwise reading or accessing the information in the chip.

34 Claims, 5 Drawing Sheets

MEMORY CHIP HOLDER AND METHOD OF USING SAME

BACKGROUND OF THE INVENTION

This invention relates to memory chips or buttons, and is directed to a holder for such chip buttons.

The productivity of workers in many industries is frequently limited or hampered by burdensome paperwork. In certain industries this problem is especially acute because the hands-on nature of the work makes it cumbersome to use traditional methods of data entry such as keystrokes on a keyboard.

For example, in the hospital industry, locating and identifying equipment and patients in large medical complexes can be a troublesome task which is not necessarily well-suited to data entry from a keyboard.

Memory chips or buttons are useful to address this type of problem by permitting the worker to gather necessary data with a minimum of effort. Relevant data is stored in the button and small hand-held instruments can be used to read that data by simply "touching" the instrument to the button (this type of chip is sometimes called a "touch memory"), by the use of radio-frequency access to the chip information (an antenna transmits the information, eliminating the need for actual direct contact with the chip), or similar data exchange technology. Through such processes, data can be gathered and/or exchanged more quickly, accurately and easily than through more traditional methods.

The useful life of the chips is extended by their reprogrammability. In the aforementioned hospital application, for example, a single chip button could be utilized with one patient until that patient is discharged, the chip then disinfected and erased, and finally reprogrammed for use with a new patient. Obviously, this process could be repeated to extend the useful life of each chip button, thereby saving resources and money and reducing ecological waste.

Even where the chips are not reprogrammable or are not "recycled" by reprogramming, there is a need for a simple, inexpensive device to securely attach the chips to a person or thing, so that the person or thing can be accurately associated with the information stored in the chip. Such a securement device would enable the aforedescribed benefits of chip button technology to be realized.

In using this chip technology to identify persons or things, it is imperative that the securement of the chip to the person or thing be relatively tamper-proof. The system would be of little value if the chips could be inadvertently dislodged or removed from the person or thing which they are to identify. In other words, once the chip is programmed with information about the person or thing, the securement device must retain the chip's physical association with that person or thing until such time as the chip is intended to be removed.

OBJECTS AND ADVANTAGES OF THE INVENTION

It is, therefore, an object of our invention to provide a housing or holder for a memory chip button that is inexpensive to manufacture and simple to operate, but reliable and secure. In its preferred embodiment, the housing or holder is useful as part of an identification bracelet assembly and includes a body portion and a closure portion, such as an integral snap-type closure or a sliding cover to retain the button in the body portion. For reprogrammable chip buttons, the snap-type closure permits removal of the button at an appropriate time for reprogramming.

Alternative embodiments would include "permanent" closures, in which the chip could not be removed except with the use of a tool, by destruction of the housing or bracelet, or through other tamper-indicating means. Such a closure would increase the security of the application, and correspondingly decrease the likelihood of fraudulent or malevolent interference witch the identification system. These security concerns apply regardless of whether the chips are to be reused.

Another object of our invention is the provision of a chip holder of the aforementioned character which permits the button to be associated with a person or thing, such as by fastening the housing to a strap or bracelet. The housing can be integral with such a strap or bracelet, can be permanently attachable to the strap or bracelet, or can be demountable or releasable from the strap or bracelet. The attachment or fastening of the housing to a strap or bracelet can be accomplished by numerous expedients, such as through use of a stud and socket structure or by openings in the housing which receive the strap.

As indicated above, it is also an object of our invention to provide a button holder which permits the button to be reused. In the preferred embodiment, the button can be removed, cleaned, sterilized, erased or otherwise processed as necessary, and then reprogrammed and reapplied to identify another person or thing.

In certain embodiments, the chip can be placed in a multi-piece housing. When the housing pieces are properly positioned to hold the chip strap-receiving openings in the pieces will be aligned and the strap can be placed through the openings to maintain the pieces in the desired alignment. The strap can then be fitted around the thing or person to be identified, such as by attaching the strap around the person's wrist.

A further object of our invention is to provide a housing of the aforementioned character in which the strap also functions to help retain the button in the housing. In such an embodiment, a single piece receptacle body receives the chip and the strap is then threaded through openings in the body so that it lies adjacent the chip and retains the chip in the body.

Yet another object of our invention is the provision of an identification bracelet assembly, which assembly includes memory chip means, strap means for encircling an object or a wearer's wrist or other appendage, and retaining means associated with the strap means for retaining the memory chip means in association with the strap means.

The retaining means preferably includes first and second interengageable portions, whereby the first portion receives the memory chip means and the second portion retains the memory chip means in the first portion. The interengagement of the portions can be accomplished, for example, by snap-type closure or by sliding interengagement. Fastening means, such as a stud and socket arrangement or a thread-through strap, can be utilized to demountably or permanently fasten the retaining means to the strap.

Still another object of our invention is the provision of a housing or holder for a memory chip button, which housing includes first and second interengageable portions such as a body portion and a closure portion, whereby the first portion receives the memory chip button and the second portion retains the memory chip button in the first portion, through sliding or snap-type interengagement or the like. Again, a strap or bracelet is used to associate the chip and housing with an object or person, and the strap may also function to maintain separate pieces of the housing in a desired alignment, whereby the chip is retained therein. The strap itself can also function to retain the chip in a single piece housing.

Other objects and advantages of the invention will be apparent from the following specification and the accompanying drawings, which are for the purpose of illustration only.

DESCRIPTION OF PREFERRED EMBODIMENT

Figure 1:
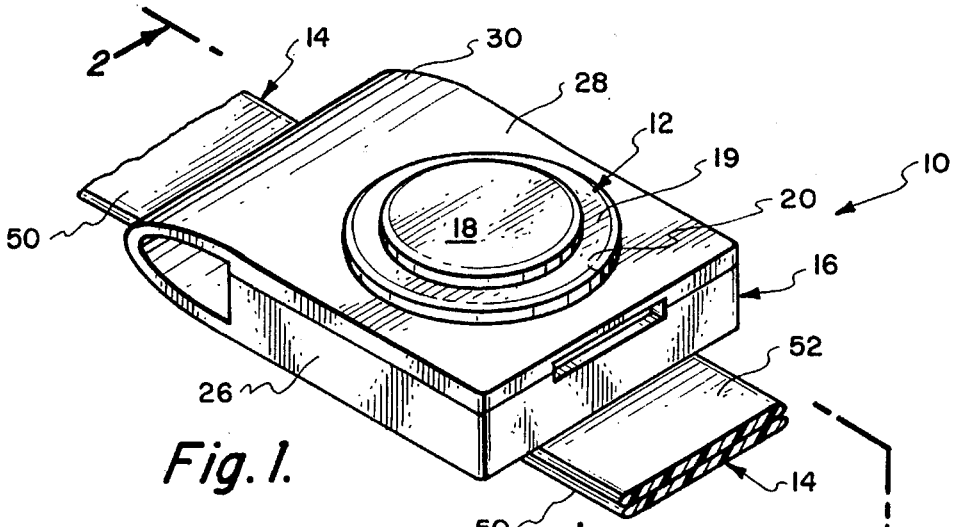
FIG. 1 is an isometric view of a memory chip housing assembly constructed in accordance with the teachings of the invention.
Figure 2:
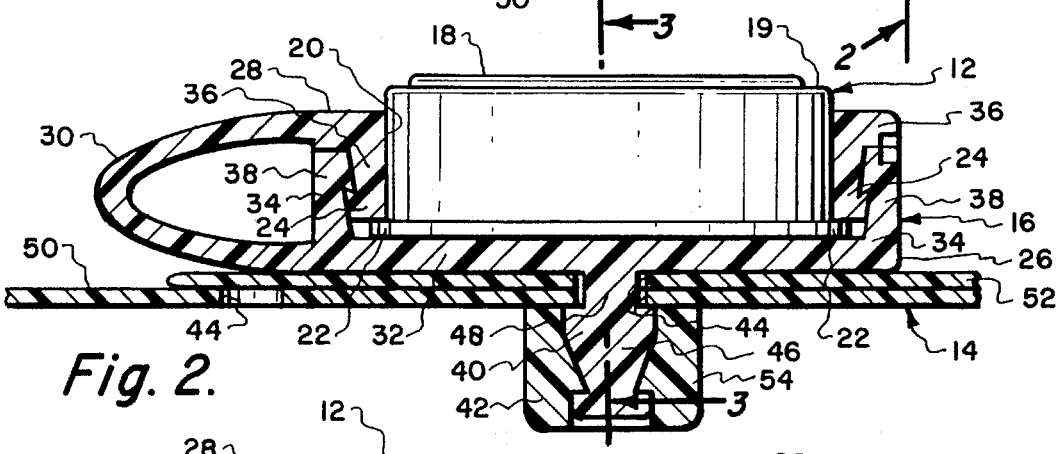
FIG. 2 is a sectional view, taken along line 2—2 of FIG. 1.
Figure 3:
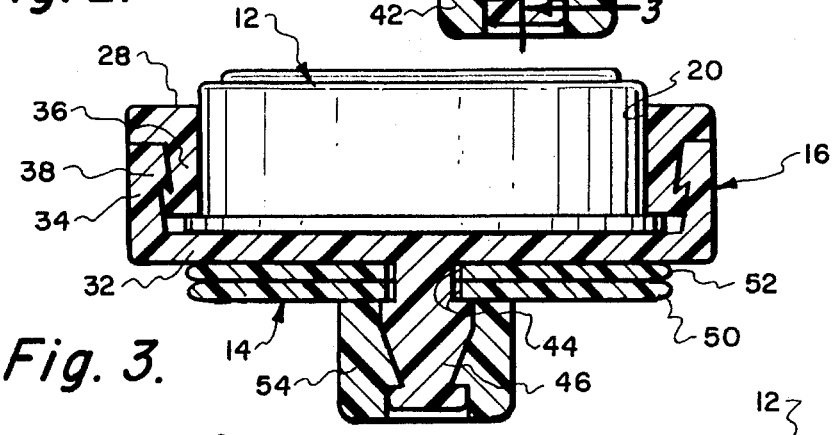
FIG. 3 is a sectional view, taken along line 3—3 of FIG. 2.

Referring to the drawings, and particularly to FIGS. 1–3 thereof, we show an identification bracelet assembly constructed in accordance with the teachings of the invention and including memory chip means such as a memory chip button 12, strap means such as a bracelet 14, and retaining means such as a housing 16 for retaining the button 12 in association with the strap or bracelet 14.

The memory chip means can be of any appropriate technology, and preferably functions to store relevant data in a form readable by any of a variety of instruments. Where necessary or helpful (such as in "touch memory chips" which require physical contact between the chip and the reading instrument), a data transmission surface 18 of the chip is exposed for contact with the reading instrument. Persons skilled in the art will understand that multiple data transmission surfaces may be provided, and/or multiple contact points on surface 18 may be utilized, in order to permit the desired data transmission. The upper surface of the chip 12 may include a recessed annular lip 19, according to chip design considerations as discussed elsewhere herein. The exposure of the data transmission surface 18 may be accomplished, for example, by the provision of an opening 20 in the housing or holder 16.

Alternative embodiments of our invention, such as those of FIGS. 15–18 discussed hereinbelow, may be utilized when transmission of information to and/or from the chip button requires access to additional surfaces of the chip. For example, in FIGS. 15–18, the sides of the chip are exposed for "touch" contact.

In the preferred embodiment of FIGS. 1–3, the chip 12 includes an annular extension 22 (of any suitable geometry) which abuts an adjacent lip 24 on the housing 16 to prevent the chip from inadvertent dislodgement through the opening 20. Those skilled in the art, however, will understand that the chip 12 can be of any of a variety of shapes and sizes. By way of example but not by way of limitation, the chip could be manufactured with multiple annular extensions or with no extensions. The chip button could even be formed in the shape of a dime or other coin.

Those skilled in the art will further understand that the particular components and capabilities of the chip button can be configured to the anticipated application. Chip design considerations include, for example, the amount of data to be stored on the chip button, the amount of computing (if any) to be done by the chip, and the "shelf-life" and usage life of the battery (if one is present). Obviously, the external size and shape of the chip, as well as the choice of data transmission technology (touch memory, radio frequency/antenna, or otherwise), directly affects the size and shape of the chip holder. Otherwise, these chip design choices should not substantially affect other aspects of the present invention.

The housing or holder 16 is fabricated by injection molding or other suitable process, and preferably includes first and second interengageable portions such as a receptacle or body 26 and a closure 28. In the preferred embodiment, the body 26 and the closure 28 are integral with one another through the provision of a flexible connecting portion 30.

Those skilled in the art will understand that the preferred connecting portion or lanyard 30 may be the full width of the body 26 and/or the closure 28 (as illustrated in FIGS. 1–4), or may be wider or narrower as indicated for any particular application, For example, the lanyard 30 could be constituted by one or more narrow strips of material connecting the body 26 and the closure 28.

The body 26 is adapted to receive the memory chip means 12, such as by the provision of a base section 32 and an attached rim section 34. The base and rim sections 32 and 34 define a receptacle for the chip means, with the chip preferably resting against! the base section 32 when assembled.

The closure 28 preferably constitutes a snap-type closure, and includes a deformable male portion or portions 36 which may be snapped into engagement with corresponding deformable female portions 38 on rim section 34. As indicated above, the male portion 36 includes a lip 24 which abuts the annular extension 22 on the chip button when in snapped engagement, thereby preventing the chip from being dislodged through the opening 20.

The housing or holder 16 may be fabricated as an integral part of the strap means 14, but is shown in the preferred embodiment of FIGS. 1–3 as being separable from the strap means. For flexibility of use and ease of manufacture, the assembly preferably includes fastening means such as mating stud and socket means 40 and 42 for attaching or fastening the housing to the strap or bracelet 14.

Those skilled in the art will understand that the strap means 14 may be fabricated from a wide variety of materials, including plastic, vinyl, leather, cloth and the like, and may be configured in any suitable configuration for attaching the assembly to a person or object to be identified. In the embodiments shown in the drawings, the strap means 14 is shown as an elongated flat strip of material.

In the embodiment of FIGS. 1–3, the strap or bracelet 14 is provided with holes 44 therein, preferably spaced along the length of the strap. The holes are preferably sized so that they will stretch and deform as they are fitted over the head portion 46 of the stud member 40 and will then return to their normal size to snugly fit the neck portion 48 of the stud member 40. In such a configuration, first and second ends 50 and 52 of the strap 14 may be fitted over the head 46 at selected holes 44, and the socket 54 then engaged with the stud head 46.

Those skilled in the art will understand that some or all of the holes 44 in ends 50 and 52 can be larger than the stud head 46 so that no "stretching" of the holes 44 is required during assembly. Such oversizing of the holes 44 permits ready adjustment of the length of the strap; that is, it is easier to move the stud head 46 from one hole 44 to another during the process of applying the strap to the person or object to be identified, prior to engaging the socket 54 with the stud head 46. To remain assembled, however, the diameter of the holes 44 must be smaller than the diameter of socket 54, so that the strap will not inadvertently slip over the socket and disengage.

Examples of suitable stud and socket engagements 40 and 54 are illustrated in U.S. Pat. No. 3,551,963 to Mosher, et al. Those skilled in the art will understand, however, that many types of stud and socket combinations may be utilized with efficacy without departing from the scope of the invention.

Figure 4:
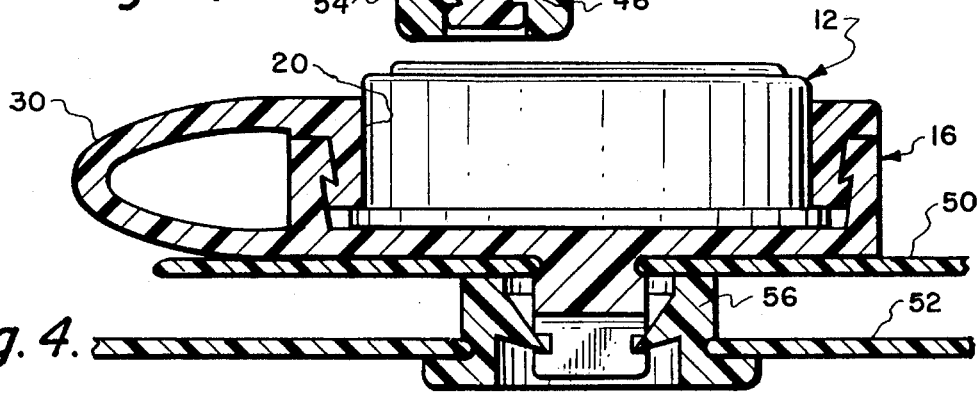
FIG. 4 is a sectional view similar to FIG. 2, but of an alternative embodiment of the invention.

In an alternative embodiment, FIG. 4, the invention is shown as including a socket member 56 associated with the second strap end 52, with the first strap end 50 operatively held against the housing 16 but spaced apart from the second strap end 52.

Those skilled in the art will also understand that, in additional embodiments not shown, the stud and socket members discussed above may be reversed in orientation. Additionally, for ease of use and other benefits, the stud and/or socket members may be operably attached to one another through the use of a second lanyard (not shown) or similar expedient. In other words, one or more strips of flexible material could connect the socket 42 to the body 26, FIG. 2.

Figure 5:
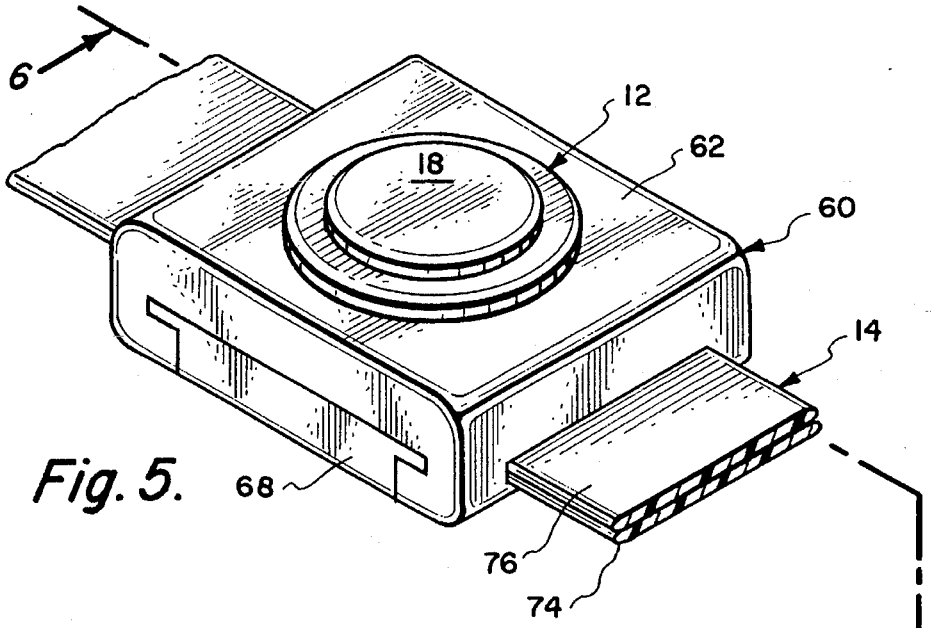
FIG. 5 is an isometric view of another alternative embodiment of the invention.
Figure 6:
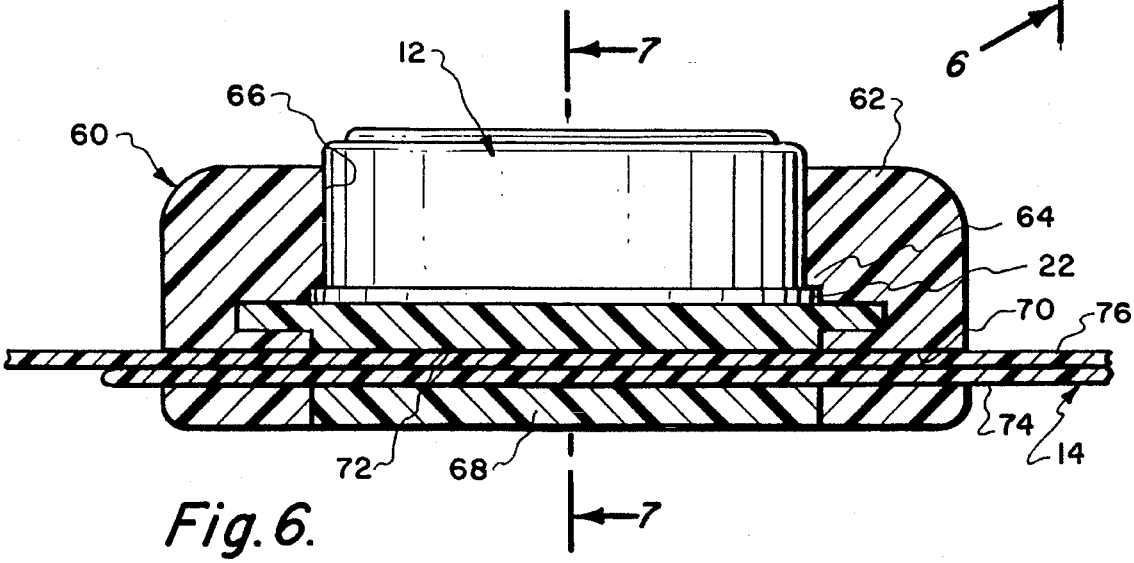
FIG. 6 is a sectional view, taken along line 6—6 of FIG. 5.
Figure 7:
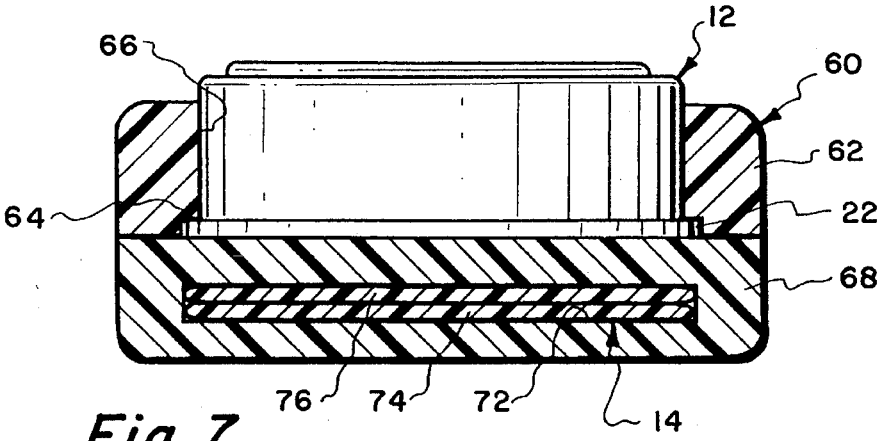
FIG. 7 is a sectional view, taken along line 7—7 of FIG. 6.

In the alternative embodiment of FIGS. 5–7, the housing or holder 60 is again a multi-piece article, and includes a first portion such as a receptacle body 62 for the memory chip means 12. As in the preferred embodiment, where it is necessary or helpful, the data transmission surface 18 of the chip is exposed for contact with reading instruments. Similar to the preferred embodiment, the chip 12 of FIGS. 5–7 includes an annular extension 22 which abuts an adjacent lip 64 on the housing 60 to prevent the chip from inadvertent dislodgement through the opening 66.

The holder of FIGS. 5–7 further includes a second portion such as a cover 68 for the memory chip 12 in the receptacle body 62. The cover 68 is shown as slidingly engaging with the receptacle body 62 and abutting the chip 12 when so assembled. To hold or maintain the cover in the desired location against the chip 12, alignable openings 70 and 72 are provided in the receptacle body 62 and cover 68, respectively, and strap or bracelet means 14 is passed through the openings.

As illustrated, the strap or bracelet means 14 includes two ends 74 and 76 thereof passed through the openings. Those skilled in the art will understand that the invention can be configured so that only one strap section (rather than two) passes through the openings. Additionally, the two pieces of the strap are preferably temporarily or permanently affixed to each other at a location not shown in the drawings, so that the strap pieces will not be inadvertently withdrawn from the openings 70 and 72. Whether or not such affixation is temporary, the assembly can be taken apart for chip reprogramming, attachment to another object or person, or the like.

Depending on the degree of "permanence" of the affixation of the various components of the assembly to one another, the strap and/or other components of the assembly (other than the chip button) may have to be destroyed or otherwise damaged to facilitate removal of the assembly from the person or thing, or to permit, the desired chip reprogramming/reuse.

Figure 8:
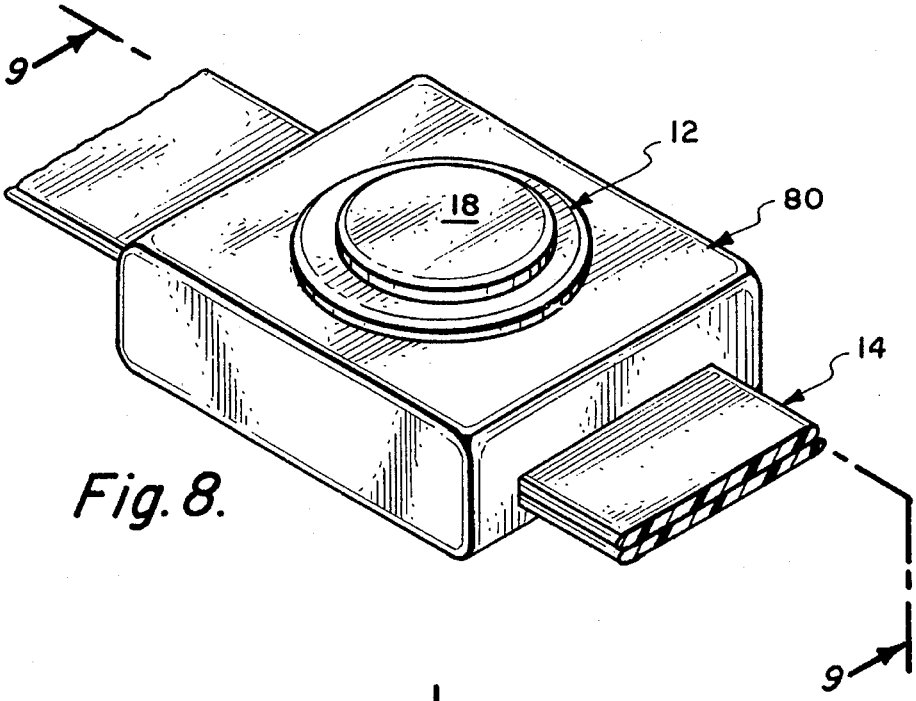
FIG. 8 is an isometric view of yet another alternative embodiment of the invention.
Figure 9:
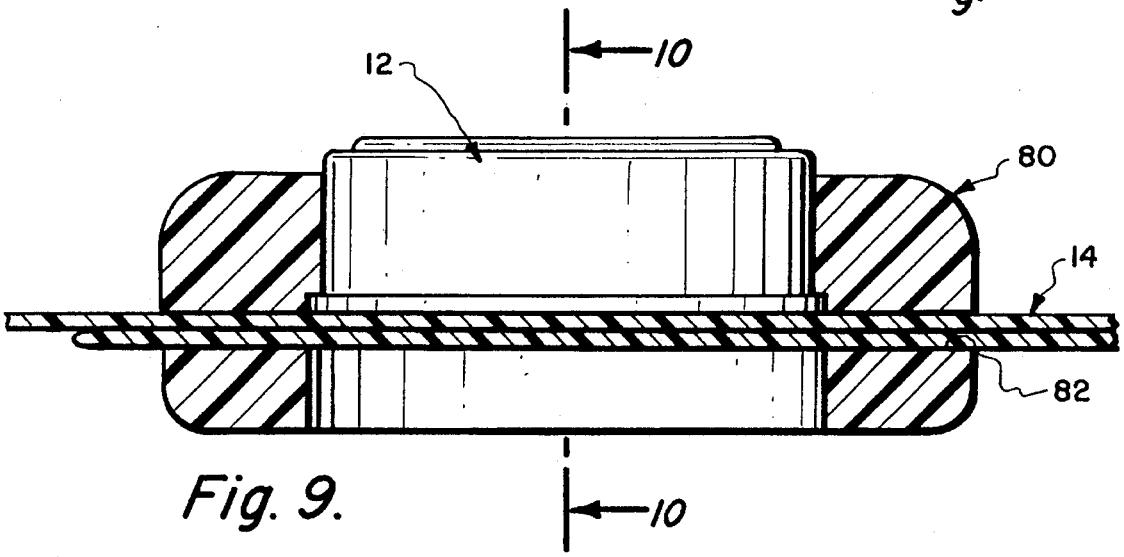
FIG. 9 is a sectional view, taken along line 9—9 of FIG. 8.
Figure 10:
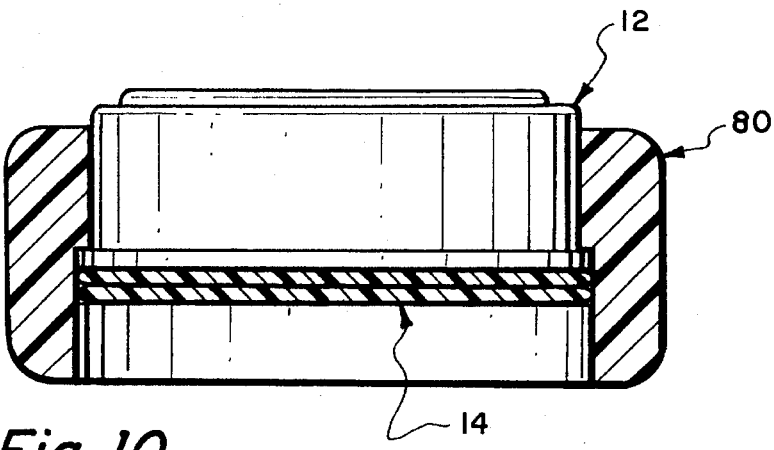
FIG. 10 is a sectional view, taken along line 10—10 of FIG. 9.

The alternative embodiment of FIGS. 8–10 illustrates a one-piece construction of a housing or holder 80. This one-piece construction. 80 is similar in most respects to the receptacle body 62 described above in connection with FIGS. 5–7. The holder 80 includes strap openings 82 positioned so that, when the strap member or members 14 are passed through the openings, those members will contact the chip button 12. Sufficient tension is provided in the strap 14 when the strap is properly assembled (by selecting an appropriately stiff strap material, tightening and fastening the strap appropriately, or the like), so that the chip is operably retained in the holder or housing 80.

For each of the various embodiments of FIGS. 11–18, the holder 90 is provided with slot means 92 through which strap means 94 passes. Those skilled in the art will understand that the ends of the strap 94 (not shown) are to be joined to one another so that the strap encircles and is retained on the object or person to be identified. Once the ends of the strap are so joined together, the holder mechanism of each embodiment (described below) may only be removed from the strap by disconnecting the ends of the strap or by destroying the strap. The holder 90 is manufactured by injection molding or other suitable process, and may be affixed to the strap by bonding, gluing, or similar expedient, or may be slidable along the strap.

Figure 11:
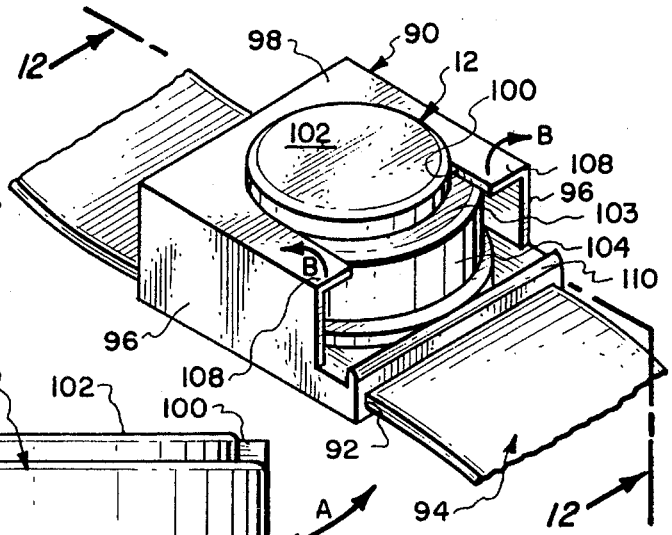
FIG. 11 is an isometric view of another alternative embodiment of the invention.
Figure 12:
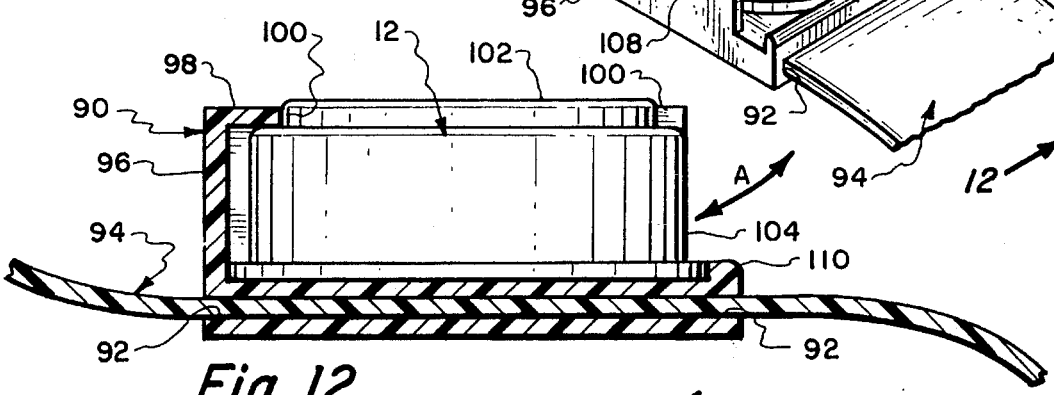
FIG. 12 is a sectional view, taken along line 12—12 of FIG. 11.

In the embodiment of FIGS. 11 and 12, the chip button 12 is inserted into the holder 90 in the direction shown by arrow A, FIG. 12. To expose various surfaces of the chip 12 for "touch-memory" transmission of information to and from the chip, the illustrated embodiment of the holder 90 includes only three sides 96 and an upper layer 98 having a U-shaped opening 100 therein. An upper surface 102 protrudes or is otherwise accessible through the U-shaped opening 100, and a portion of the side surface 104 of the chip is exposed, whereby both are accessible for physical contact with a mechanical or electrical sensing device for data transmission purposes.

The chip button 12 is retained in the holder 90 by the overlapping of the edge of the U-shaped opening 100 over a recessed annular lip 103 (similar to lip 19 in FIG. 1), or over the data transmission surface 102 (this alternative relationship of the U-shaped opening overlying surface 102 is not shown in FIGS. 11 and 12). Additionally, a retaining lip 110 is provided along the front edge of the holder 90 to abut the chip 12 on the "open" side of the holder 90. Those skilled in the art will understand that the lip 110 may be provided across the full width of the holder 90 (as illustrated) or may alternatively be provided in a form less than the full width of the holder (see, for example, the narrower lip illustrated in FIG. 15), so long as the lip 110 provides the desired chip-retaining function.

To facilitate the insertion and subsequent removal of the chip button 12, the corners 108 formed by the U-shaped opening 100 are preferably flexible in the direction indicated by arrows B. Except during insertion or removal of the chip along the direction of arrow A, the corners 108 preferably remain in the position illustrated in FIGS. 11 and 12. Thus, the chip button 12 may be "snapped" into the holder 90 when desired.

As persons skilled in the art will understand, it is frequently desirable (for security reasons or otherwise) to provide some tamper-evidencing means to indicate when a chip has been removed from the holder. This tamper-evidencing might include, for example, the required destruction or permanent deformation of the holder in order to accomplish the removal of the chip. Such tamper-evidencing can be accomplished, for example, by appropriately selecting the holder materials (that is, selection of materials having a desired flexibility and/or stiffness) and appropriately designing the dimensional tolerances of the holder.

Figure 13:
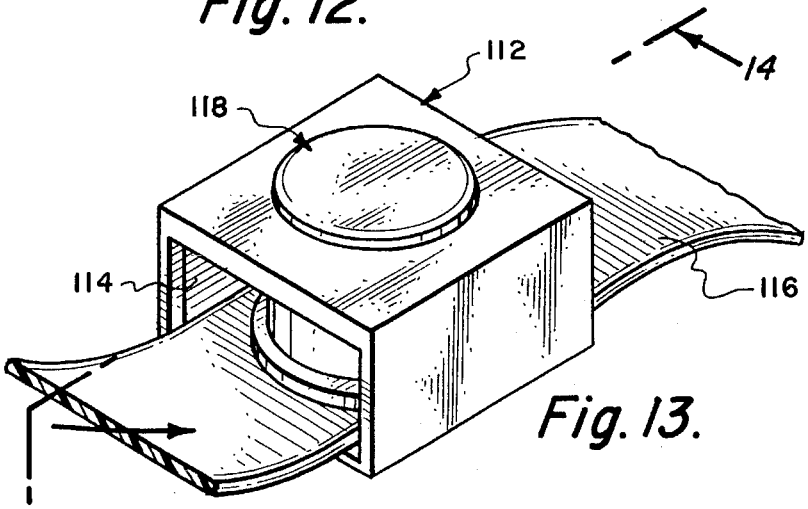
FIG. 13 is an isometric view of still another alternative embodiment of the invention.
Figure 14:
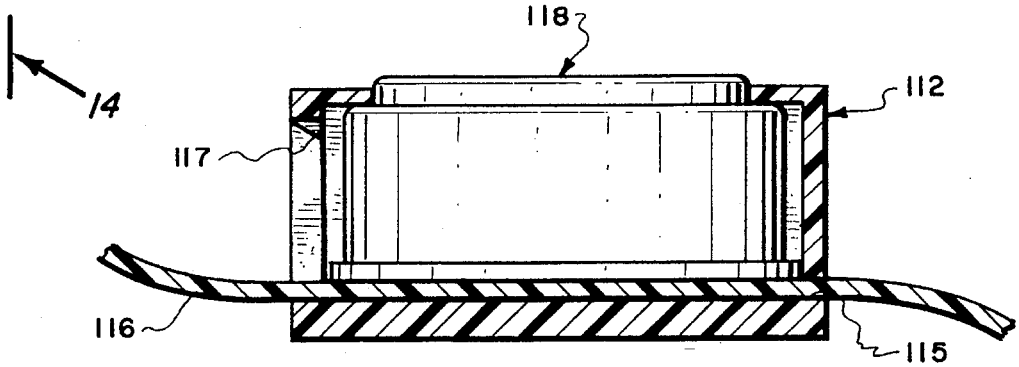
FIG. 14 is a sectional view, taken along line 14—14 of FIG. 13.

The holder 112 shown in FIGS. 13 and 14 includes a tapered and/or enlarged opening 114 in one side thereof, and an opening 115 in the opposing side. The openings 114 and 115 permit a retaining strap 116 to be passed through the holder, similarly to the abovedescribed embodiments. Likewise, the ends of the strap 116 (not shown) are joined to one another in an encircling relationship for retention on a person or thing.

The tapered/enlarged opening 114 enables the insertion and/or removal of the chip 118 into the holder 112. By providing a tapered or sloped surface 117 as illustrated, insertion is facilitated but removal of the chip is intentionally made more difficult (to prevent inadvertent or undesired removal or exchange of the chip). To further assist the insertion of the chip, the holder 112 is preferably fabricated from a flexible, resilient material that permits the opening 114 to be stretched to accommodate the insertion or removal of the chip button 118 therethrough and then return to its illustrated configuration.

Those skilled in the art will understand that a tapered and/or enlarged opening similar to opening 114 may also be provided in place of the illustrated opening 115, and thereby permit the chip button 118 to be inserted into the holder from either end. Likewise, such persons will understand that the holder material and the dimensions of the opening 114 can be selected to make it difficult to remove the button 118 after insertion (thus requiring destruction of the holder 112 in order to remove the chip).

FIGS. 15–18 illustrate another alternative embodiment of the invention, along with an exemplary "touch" data transmission device for reading the data from the chip button and/or for storing data into the chip button. As shown, the holder 120 and strap 122 are constructed similarly to the embodiment of FIGS. 11 and 12. Likewise, the chip 130 is preferably engaged with the holder 120 in a manner similar to that described above for the embodiment of FIGS. 11 and 12. Unlike the embodiment of FIGS. 11 and 12, however, the upper layer 124 having a U-shaped opening 126 therein abuts and overlies in a retaining relationship an annular extension 128 on the chip 130.

Figure 15:
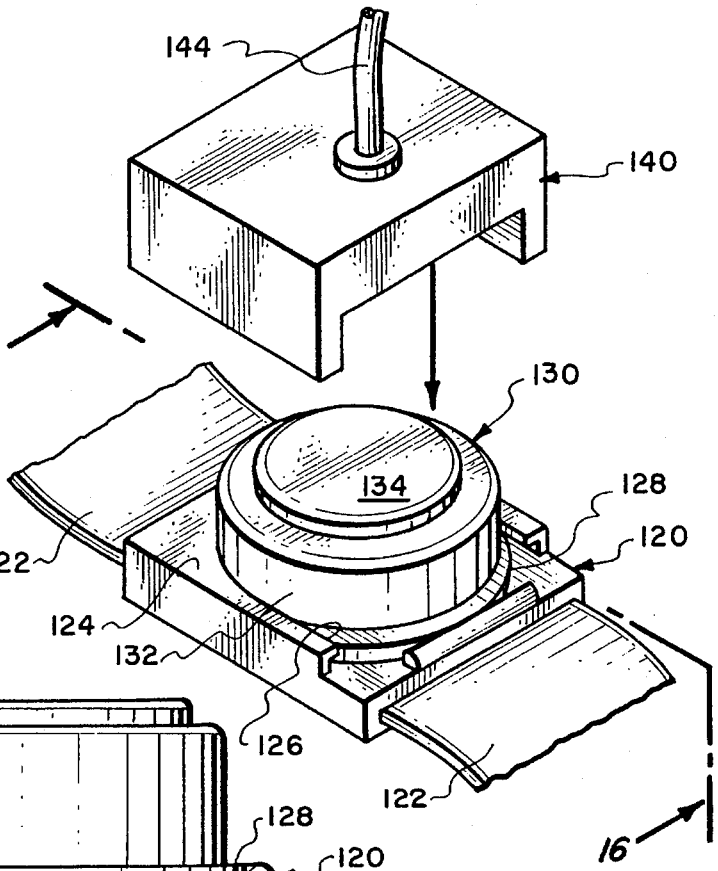
FIG. 15 is an isometric view of an additional alternative embodiment of the invention.
Figure 16:
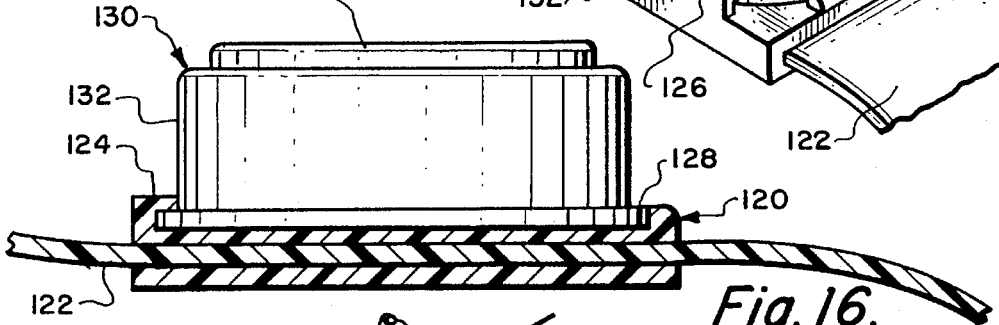
FIG. 16 is a sectional view, taken along line 16—16 of FIG. 15.
Figure 17:
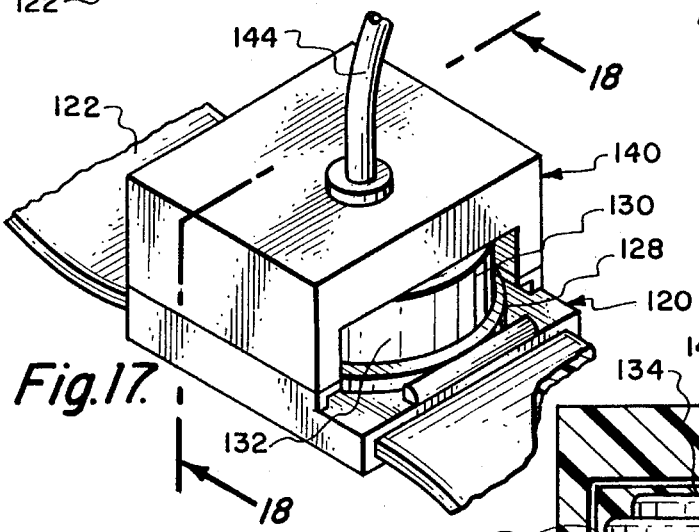
FIG. 17 is an isometric view of the embodiment of FIG. 15 of the invention, showing the components assembled for transmission of data from the chip.
Figure 18:
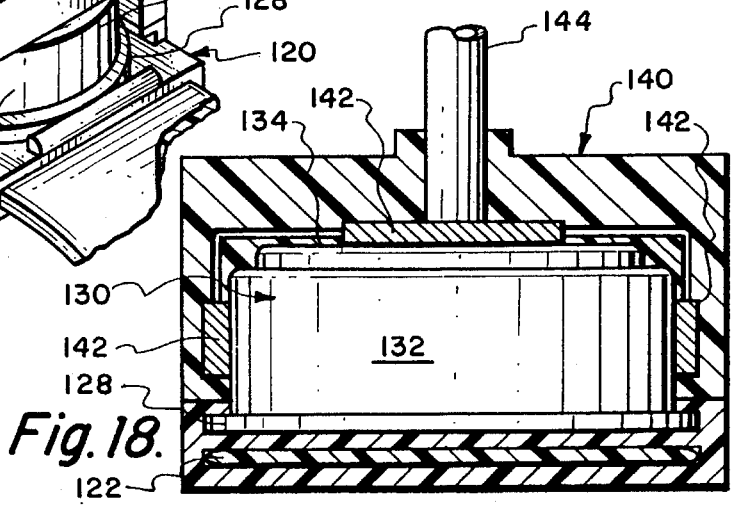
FIG. 18 is a sectional view, taken along line 18—18 of FIG. 17.

The location of the upper layer 124 permits the entire circumference of the side 132 of the chip 130, as well as the upper surface 134 of the chip 130, to be exposed for the aforementioned "touch" data transmission. An exemplary data transmission device 140 for such "touch" data transmission is illustrated in FIGS. 15, 17 and 18, and includes sensing means 142, FIG. 18, configured so that they may be placed in contact with the data transmission surfaces 132 and 134. The sensing means 142 is operably connected to transmit the chip data through a transmission line 144, which is connected at its remote end to any of a variety of electronic data gathering/processing devices (not shown).

Those skilled in the art will also understand that many of the structures shown in the drawings may be utilized effectively with chip button memories that do not require "touch" transmission of data. In such applications, the various touch surfaces of the chips shown in the drawings would not need to be exposed, but instead could be covered by slightly modifying the various holder structures. Similarly, and as indicated above, in certain applications the strap members may be manufactured integrally with the holder structures. Of course, even in "touch memory" applications, reading devices other than the one illustrated in FIGS. 15, 17 and 18 may be utilized to obtain the data from the chip buttons.

Those skilled in the art will further understand that the strap members discussed herein facilitate use of the invention in a wide range of applications. For example, the strap may encircle a person's wrist in a fixed loop, thereby permitting desired information in the chip button to be associated with that person (this use might be typical in a hospital for patients, staff or the like).

A preferred method of such a hospital use might include, for example, the steps of storing information in a chip button, inserting the chip button in a selected holder (with appropriate "writeable" chip technology, these first two steps can be done in reverse order), attaching the holder/chip assembly to a person or thing to be associated with the stored information, and transmitting or otherwise reading or accessing the information in the chip. Additional useful steps would include removing the assembly from the person or thing and processing the chip button for reuse. Such processing might include, for example, erasing the information from the chip, cleaning and/or sterilizing the chip and/or the holder/strap components, and reassembling the chip in a holder.

Persons skilled in the art will understand that many of the foregoing steps could be reordered in a variety of ways with equal efficacy, depending on the circumstances and particular application in which the invention is to be used.

Thus, by our invention, we provide a simple and inexpensive device to enable memory chip buttons to be readily used in numerous applications. We further provide a useful method for identifying a person or thing using a memory button or chip.

The button housing assembly and method of our invention has been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

We claim:

1. In an identification bracelet assembly, the combination of: memory chip means; strap means for encircling an object or a wearer's wrist or other appendage; retaining means associated with said strap means for retaining said memory chip means in association with said strap means; and tamper-indicating means for indicating the disassociation of said memory chip means from the object or wearer.

2. In an identification bracelet assembly, the combination of memory chip means; strap means for encircling an object or a wearer's wrist or other appendage; and retaining means associated with said strap means for retaining said memory chip means in association with said strap means, in which said retaining means includes first and second interengageable portions, whereby said first portion is adapted to receive said memory chip means and said second portion is adapted to retain said memory chip means in said first portion.

3. The assembly of claim 2, in which said first portion of said retaining means constitutes a receptacle body and said second portion constitutes a snap-type closure integral therewith.

4. The assembly of claim 2, in which said first portion of said retaining means constitutes a receptacle body with said memory chip means therein and said second portion constitutes a cover for said receptacle body, in which said cover and said receptacle body are demountable from each other by sliding interengagement.

5. The assembly of claim 1, in which said retaining means is separable from said strap means.

6. The assembly of claim 5, in which said retaining means includes first and second interengageable portions, whereby said first portion is adapted to receive said memory chip means and said second portion is adapted to retain said memory chip means in said first portion.

7. The assembly of claim 6, in which said first portion of said retaining means constitutes a receptacle body and said second portion constitutes a snap-type closure integral therewith.

8. The assembly of claim 1 or claim 2, further including fastening means for fastening said retaining means to said strap means.

9. The assembly of claim 8, in which said fastening means includes mating stud and socket means, wherein said stud means extends through one or more openings in said strap means and interfits with said mating socket means.

10. The assembly of claim 8, in which said fastening means includes openings in said retaining means through which said strap means is inserted.

11. The assembly of claim 10, in which said strap means is disposed adjacent said memory chip means in a retaining relationship.

12. A housing for a memory chip button, including first and second interengagable portions, whereby said first portion is adapted to receive a memory chip button and said second portion is adapted to retain the memory chip button in said first portion; further including tamper-indicating means for indicating the disassociation of the memory chip button from said housing.

13. The housing of claim 12, in which said housing includes openings through which strap means is inserted, and said strap means is adapted to encircle an object whereby the memory chip button may be associated with the encircled object.

14. The housing of claim 13, in which said strap means is disposed adjacent the memory chip button.

15. The housing of claim 12, in which said first portion constitutes a receptacle body and said second portion constitutes a cover for said receptacle body, in which said cover and said receptacle body are demountable from each other by sliding interengagement.

16. The housing of claim 15, in which said housing includes openings through which strap means is inserted, said strap means being adapted to encircle an object whereby the memory chip button is associated with the encircled object.

17. The housing of claim 16, in which said housing includes openings through which said strap means is inserted, said strap means being adapted to encircle an object whereby the memory chip button is associated with the encircled object, in which said openings exist in both said receptacle body and said cover, and said openings may be operably aligned when said cover is slidingly engaged with said body, whereby said strap means maintains said engagement between said body and said cover when said strap means is inserted through said aligned openings.

18. The housing of claim 16, in which said strap means is disposed adjacent the memory chip button.

19. The housing of claim 12, including a snap-type closure to accomplish the interengagement of said first portion and said second portion.

20. The housing of claim 19, in which said housing includes openings through which strap means is inserted, said strap means being adapted to encircle an object whereby the memory chip button is associated with the encircled object.

21. The housing of claim 20, in which said strap means is disposed adjacent the memory chip button.

22. The housing of claim 13 or claim 14 or claim 16 or claim 17 or claim 18 or claim 20 or claim 21, in which said housing is releasably affixed to said strap means.

23. A holder for a memory chip button, including a body portion for receiving said button, a closure portion adapted to retain the memory chip button in said first portion, and tamper-indicating means for indicating the disassociation of the memory chip button from said holder.

24. The holder of claim 23, in which said closure portion is integral with said body portion, further including snap-type closure means acting between said body portion and said closure portion.

25. The holder of claim 23, in which said closure portion constitutes a cover that is slidably engaged with said body portion.

26. The holder of claim 23 or claim 24 or claim 25, in which said holder includes openings through which strap means is inserted, and said strap means is adapted to encircle an object whereby the memory chip button is associated with the encircled object.

27. The holder of claim 26, in which said strap means is adjacent the memory chip button to retain the button in the holder.

28. A method of identifying a person or thing, including the steps of:

storing information in a chip button;

inserting said chip button in a selected holder, said holder including strap means for encircling the person's wrist or other appendage or the thing, said holder further including retaining means associated with said strap means for retaining said chip button in association with said strap means, in which said retaining means includes a resilient body portion having an opening therein and a retaining lip adjacent said opening, whereby said opening may be deformed to permit the insertion of said chip button into said body portion and said retaining lip assists in retaining said chip button in said body portion;

attaching the holder/chip assembly to a person or thing to be associated with the stored information; and transmitting or otherwise reading or accessing the information in the chip.

29. The method of claim 28, further including the steps of:

removing the assembly from the person or thing; and processing the chip button for reuse.

30. The method of claim 29, in which said processing step includes:

erasing the information from the chip;

cleaning and/or sterilizing the chip and/or the holder components; and reassembling the chip in a holder.

31. An identification bracelet assembly, including: bracelet means for encircling the wrist or some other portion of a person or thing to be identified; fastening means for fastening said bracelet means in said encircling relationship; memory chip means for storage and retrieval of identifying information regarding the person or thing to be identified; and memory chip retaining means for retaining said memory chip means in proximity to said bracelet means; said retaining means including interengagable first and second portions adapted and configured to be assembled about said memory chip means; further including tamper-indicating means for indicating the disassociation of the memory chip button from said housing.

32. An identification bracelet assembly, including: bracelet means for encircling the wrist or some other portion of a person or thing to be identified; fastening means for fastening said bracelet means in said encircling relationship; memory chip means for storage and retrieval of identifying information regarding the person or thing to be identified; and memory chip retaining means for retaining said memory chip means in proximity to said bracelet means; and retaining means including interengagable first and second portions adapted and configured to be assembled about said memory chip means, in which said first interengagable portion includes a centrally disposed section against which said memory chip means is placed, and further includes one or more mating engagement members disposed about said centrally disposed section; and in which said second interengagable portion includes a corresponding one or more mating engagement members configured to engage said mating engagement members on said first interengagable portion, and further includes a retaining portion for retaining said memory chip means against said centrally disposed section.

33. An identification bracelet assembly, including: bracelet means for encircling the wrist or some other portion of a person or thing to be identified; fastening means for fastening said bracelet means in said encircling relationship; memory chip means for storage and retrieval of identifying information regarding the person or thing to be identified; and memory chip retaining means for retaining said memory chip means in proximity to said bracelet means; said retaining means including interengagable first and second portions adapted and configured to be assembled about said memory chip means, in which said first interengagable portion includes a centrally disposed section against which said memory chip means is placed, and further includes one or more mating engagement members disposed about said centrally disposed section; and in which said second interengagable portion includes a corresponding one or more mating engagement members configured to engage said mating engagement members on said first interengagable portion, and further includes a retaining portion for retaining said memory chip means against said centrally disposed section in which said mating engagement members include interfitting flexible male and female projections capable of deforming to permit the desired interengaging assembly about said chip means and of thereafter resiliently engaging with each other following such assembly to prevent the inadvertent disengagement of said interengagable first and second portions from each other, and in which said memory chip means includes retaining lip means protruding about the periphery thereof and said retaining portion for retaining said memory chip means against said centrally disposed section includes a corresponding protrusion dimensioned to abut said retaining lip and thereby prevent the dislodgement of said chip means from said assembly.

34. In an identification bracelet assembly, the combination of: memory chip means; strap means for encircling an object or a wearer's wrist or other appendage; and retaining means associated with said strap means for retaining said memory chip means in association with said strap means, in which said retaining means includes a resilient body portion having an opening therein and a retaining lip adjacent said opening therein and a retaining lip adjacent said opening, whereby said opening may be deformed to permit the insertion of said memory chip means into said body portion and said retaining lip assists in retaining said memory chip means in said body portion.

* * * * *

UNITED STATES PATENT AND TRADEMARK OFFICE

CERTIFICATE OF CORRECTION

PATENT NO. : 5,493,805

DATED : Feb. 27, 1996

INVENTOR(S) : Oswaldo Penuela, et al

It is certified that error appears in the above-indentified patent and that said Letters Patent is hereby corrected as shown below:

In Col. 2, line 31, after "chip", add--,--.

In Col. 3, line 57, after "assembly", add--10--.

In Col. 4, line 59, after "against", remove--!--.

Column 9, line 10 after "of", add--:--.

Column 11, line 35, replace "and" with--said--.

Column 12, line 42 before "whereby", delete--therein and a retaining lip adjacent said opening,--.

Signed and Sealed this

Thirtieth Day of July, 1996

Bruce Lehman

*Attest:*

BRUCE LEHMAN

*Attesting Officer*

*Commissioner of Patents and Trademarks*